United States Patent [19]

Nakanishi

[11] 4,270,579

[45] Jun. 2, 1981

[54] SENSOR WEFT MECHANISM FOR FLUID JET LOOMS

[75] Inventor: Masakazu Nakanishi, Kanazawa, Japan

[73] Assignee: Tusdakoma Kogyo Kabushiki Kaisha, Japan

[21] Appl. No.: 26,673

[22] Filed: Apr. 3, 1979

[30] Foreign Application Priority Data

Apr. 4, 1978 [JP] Japan ..... 53-044614

[51] Int. Cl.[3] ..... D03D 51/34

[52] U.S. Cl. ..... 139/370.2

[58] Field of Search ..... 139/336, 370.1, 370.2; 66/163; 226/11, 100; 242/37 R

[56] References Cited

U.S. PATENT DOCUMENTS

| | | | |
|---|---|---|---|
| 3,495,633 | 2/1970 | Sakamoto et al. | 139/370.2 |
| 3,744,533 | 7/1973 | Yano et al. | 139/370.2 |
| 4,082,119 | 4/1978 | Washino | 139/370.2 |

FOREIGN PATENT DOCUMENTS

| | | | |
|---|---|---|---|
| 45-34791 | 11/1970 | Japan | 139/370.2 |

*Primary Examiner*—Henry Jaudon

*Attorney, Agent, or Firm*—Ostrolenk, Faber, Gerb & Soffen

[57] ABSTRACT

In addition to the weft sensors used in the conventional weft sensor mechanism, an additional weft sensor is arranged on the outer side at a position beyond approach by the leading end of normally inserted wefts. Misjudgement due to intermediate weft insertion is fully avoided.

5 Claims, 10 Drawing Figures

SENSOR WEFT MECHANISM FOR FLUID JET LOOMS

BACKGROUND OF THE INVENTION

The present invention relates to improved weft sensor mechanism for fluid jet looms, and more particularly relates to improvement in construction of a weft sensor mechanism in which a plurality of electrode or photocell type sensors are arranged on the arrival side of wefts facing the running path of the wefts.

On a weaving loom equipped with the conventional weft sensor mechanism of the electrode type, a pair of electrode type sensors are mounted to the reed end on the arrival side of weft facing the running path of the wefts in order to detect success in weft insertion. The sensors or feelers are properly spaced from each other along the running path of the wefts and both are coupled to a common given electric detection circuit.

When weft insertion is carried out normally, the leading end portion of a weft safely reaches the arrival side of wefts and comes in contact with both feelers, the two feelers are electrically connected to each other, and the detection circuit judges that weft insertion has been carried out normally.

When weft insertion is carried out abnormally, the leading end portion of a weft does not safely reach the arrival side of weft, the two feelers are left electrically disconnected from each other, and the detection circuit judges that weft insertion has been carried out abnormally in order to generate a signal to stop running of the loom.

So far as the above-described situations are concerned, there is no problem with the conventional sensor mechanism. Trouble starts when weft breakage happens at or near the midpoint of the weaving width. In this case, the leading end portion of a weft per se safely reaches the arrival side of wefts and the pair of feelers are electrically connected to each other just as they are when weft insertion has been carried out normally. Thus, the detection circuit judges that weft insertion has been carried out normally and the loom goes on running although, actually, weft insertion could not be carried out normally due to the intermediate weft breakage.

This misjudgement by the conventional weft sensor mechanism apparently results in production of a woven cloth including serious weaving defects. In order to remove the weaving defects, considerably time- and labor-consuming work for repair is required.

SUMMARY OF THE INVENTION

It is the primary object of the present invention to provide a weft sensor mechanism which is quite free of misjudgement conventionally caused by intermediate weft breakages.

It is another object of the present invention to provide a weft sensor mechanism which successfully prevents undesirable production of weaving defects caused by intermediate weft breakages, thereby greatly enhancing quality of woven cloths to be produced.

It is the other object of the present invention to provide a weft sensor mechanism which greatly contributes to reduction in work needed for repair of weaving defects caused by intermediate weft breakage.

In accordance with the basic concept of the present invention, an additional sensor is arranged on the outer side of the outermost conventional sensor at a position beyond approach by the leading ends of normally inserted wefts.

DESCRIPTION OF PREFERRED EMBODIMENTS

Figure 1A:
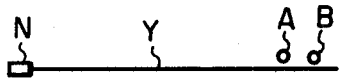
Fig. 1A PRIOR ART
FIGS. 1A to 1C are explanatory plan views of the weft insertion system employing the conventional weft sensor mechanism.
Figure 1B:
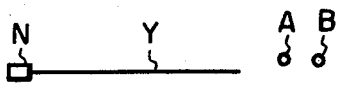
Fig. 1B PRIOR ART
Figure 1C:
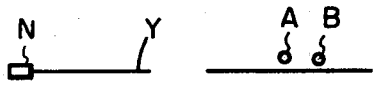
Fig. 1C PRIOR ART

In the conventional arrangement shown in FIGS. 1A to 1C, a weft Y is inserted into the shed by an ejection nozzle N and a pair of electrode type feelers A and B are arranged on the arrival side of wefts facing the running path of wefts. Normal weft insertion is shown in FIG. 1A and abnormal weft insertion is shown in FIG. 1B wherein the leading end portion of the weft does not reach the arrival side of weft. FIG. 1C also depicts an abnormal weft insertion in which the leading end portion of the weft safely reaches the arrival side of wefts but is broken at an intermediate point. This situation causes the above-described misjudgement by the conventional weft sensor mechanism.

The positive logic theory shall be used in the following description. That is, the logic "1" designates the condition that the feelers have detected presence of a weft whereas the logic "0" designates the condition that the sensors have detected absence of a weft.

Figure 2A:
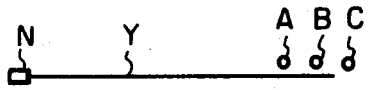
FIGS. 2A to 2C are explanatory plan views of the weft insertion system using the weft sensor mechanism in accordance with the present invention in which electrode type sensors are used.
Figure 2B:
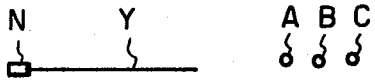
Figure 2C:
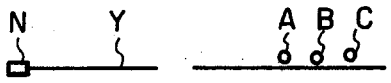

In the arrangement shown in FIGS. 2A to 2C, the present invention is applied to a weft sensor mechanism in which electrode type sensors are used. In addition to the conventionally used two sensors A and B, an electrode type feeler C is arranged on the outer side of the outer sensor B at a position beyond the point reached by the leading end of normally inserted wefts.

In connection to the later described electric detection circuit, two out of the three feelers A, B, C are freely paired to each other. One example of the pairing is shown in Table 1.

TABLE 1

| Group | feeler | |
|---|---|---|
| X | A · B | A · B |
| Y | A · C | B · C |

In the following example, the group X includes the sensors A and B whereas the group Y includes the feelers A and C.

In the case of the normal weft insertion shown in FIG. 2A, the leading end portion of the weft Y is brought into contact with the two feelers A and B but not with the outermost feeler C, since the length of the weft for one pick is usually fixed on fluid jet weaving looms. Thus, the feelers A and B are electrically connected to each other whereas the feelers A and C are electrically disconnected from each other. In other words, X is equal to 1 and Y is equal to 0.

In the case of the abnormal weft insertion shown in FIG. 2B, the leading end portion of the weft Y is in contact with neither of the feelers A, B and C. Thus, the feelers A and B and the feelers A and C are both electrically disconnected from each other, respectively. In other words, X and Y are both equal to 0.

In the case of the intermediate weft breakage shown in FIG. 2C, the leading end portion of the weft Y is in contact with all of the feelers A, B and C. Thus, the feelers A and B and the feelers A and C are both electrically connnected to each other, respectively. In other words, X and Y are both equal to 1.

The above-described three modes are summerized in Table 2.

TABLE 2

| FIGURE | Situation | X | Y |
|---|---|---|---|
| FIG. 2A | Normal weft insertion | 1 | 0 |
| FIG. 2B | Abnormal weft insertion | 0 | 0 |
| FIG. 2C | Intermediate weft breakage | 1 | 1 |

Like modes are shown in Table 3 for the case in which the group X includes the feelers A and B whereas the group Y includes the feelers B and C.

TABLE 3

| FIGURE | Situation | X | Y |
|---|---|---|---|
| FIG. 2A | Normal weft insertion | 1 | 0 |
| Fig. 2B | Abnormal weft insertion | 0 | 0 |
| FIG. 2C | Intermediate weft breakage | 1 | 1 |

As is clear from the above-described analysis, the feeler combination mode of the groups X and Y has no influence upon the value combination mode of the groups X and Y. Running of the weaving loom must be stopped in the case of the abnormal weft insertion and the intermediate weft breakage. In order to cause automatic stoppage in running of the weaving loom, the groups X and Y should be electrically connected to a proper detection circuit so that output Z of such a detection circuit should be used for stoppage in running of the weaving loom. The relationship (Truth table) between the three values X, Y and Z is shown in Table 4.

| Input to the circuit | | Output from the circuit |
|---|---|---|
| X | Y | Z |
| 1 | 0 | 0 |
| 0 | 0 | 1 |
| 1 | 1 | 1 |

The above-described relationship between the values X, Y and Z is that of the inputs and output of a coincidence circuit. Therefore, the detection circuit used for this purpose may take the form shown in FIG. 3.

The feelers A and B are coupled to a detection circuit 31 via a detector 11, an amplifier 13, a waveform shaping circuit 15 and a memory 17 which are connected to each other in the described order, thereby passing the input X to the detection circuit 31. Likewise, the feelers A and C are coupled to the detection circuit 31 via a detector 21, an amplifier 23, a waveform shaping circuit 25 and a memory 27, thereby passing the input Y to the detection circuit 31.

Upon receipt of the inputs X and Y, the detection circuit 31 generates the output Z to be fixed thereby in order to pass it to the drive control system of the weaving loom. A reset signal generator 29 is affixed to the detection circuit 31 so that the generator 29 passes reset signals RES to the memories 17 and 27 for resetting purpose upon receipt of every clock pulse signal CP.

Figure 3:
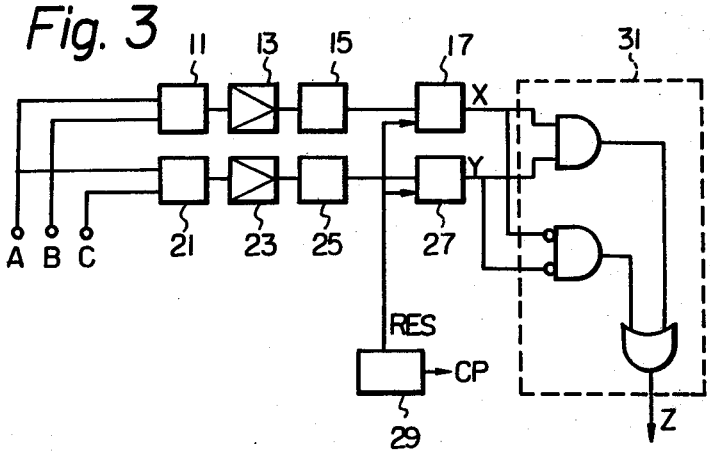
FIG. 3 is a block diagram of one example of the detection circuit advantageously used in combination with the weft sensor mechanism in accordance with the present invention.
Figure 4A:
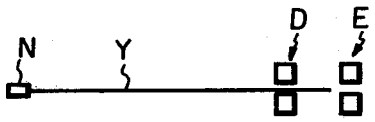
FIGS. 4A to 4C are explanatory plan views of the weft feeler mechanism in accordance with the present invention in which photo cell type sensors are used.
Figure 4B:
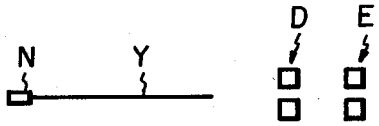
Figure 4C:
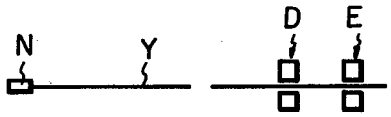

The present invention is also applicable to a weft sensor mechanism in which photo-cell type sensors are used. The weft insertion system of this type is shown in FIGS. 4A to 4C, in which each sensor comprises a paired photo-cell and a light source. On the outer side of the conventional photo-cell type sensor D, an additional like sensor E is arranged at a position beyond the point reached by the leading end of normally inserted wefts. The sensor D is designed to generate a signal X whereas the sensor E is designed to generate a signal Y. The sensors D and E are electrically connected to a detection circuit such as shown in FIG. 3.

We claim:

1. An improved weft sensor mechanism for a fluid jet loom, comprising:

first weft sensor means for determining when a weft has been properly inserted into the loom;

additional weft sensor means for determining when a weft inserted into the loom has been broken; and circuit means cooperating with said weft sensor means to form a detection circuit for determining whether the weft has been properly or improperly inserted and whether it has been broken, and for stopping the loom when a weft has been inserted into the loom improperly or has been broken or both.

2. An improved weft sensor mechanism for a fluid jet loom as claimed in claim 1, in which said first weft sensor means is disposed at a first location which enables said first weft sensor means to detect that a weft that has not been broken has been properly inserted into the loom, and in which said additional weft sensor means is disposed at a second location which enables said second weft sensor means to detect a weft that has been inserted into the loom if and only if the weft is broken.

3. An improved weft sensor mechanism as claimed in claim 1 or 2, in which said first weft sensor means comprises first and second electrode-type weft sensors, said additional weft sensor means comprises a third electrode-type weft sensor, and said weft sensors are selectively electrically connected in pairs.

4. An improved weft sensor mechanism as claimed in claim 3, in which said first and second electrode-type weft sensors are electrically connected and in which said third electrode-type weft sensor is electrically connected with one of said first and second electrode-type weft sensors.

5. An improved weft sensor mechanism as claimed in claim 1 or claim 2, in which said weft sensor means comprise photocell type sensors.

* * * * *